US005268547A

United States Patent [19]

Bessyo et al.

[11] Patent Number: 5,268,547

[45] Date of Patent: Dec. 7, 1993

[54] HIGH FREQUENCY HEATING APPARATUS UTILIZING INVERTER POWER SUPPLY

[75] Inventors: Daisuke Bessyo; Naoyoshi Maehara, both of Nara; Yuji Nakabayashi, Yamatokooriyama; Takahiro Matsumoto, Nara, all of Japan

[73] Assignee: Matsushita Electric Industrial Co., Ltd., Osaka, Japan

[21] Appl. No.: 757,531

[22] Filed: Sep. 11, 1991

[30] Foreign Application Priority Data

Sep. 11, 1990 [JP] Japan ..... 2-242082

[51] Int. Cl.[5] ..... H05B 6/68

[52] U.S. Cl. ..... 219/10.55 B; 219/10.55 R; 219/10.55 C; 219/10.55 D; 363/21; 363/56; 363/97

[58] Field of Search ..... 219/10.55 B, 10.55 R, 219/10.55 C, 10.55 D, 10.77, 10.75, 10.55 E; 363/21, 55, 56, 97

[56] References Cited

U.S. PATENT DOCUMENTS

| | | | |
|---|---|---|---|
| 3,829,649 | 8/1974 | Igarashi | 219/10.55 B |
| 4,100,463 | 7/1978 | Sugie | 219/10.55 R |
| 4,221,949 | 9/1980 | Mirakawa | 219/10.55 C |
| 4,245,143 | 1/1981 | Miura et al. | 219/10.55 B |
| 4,297,558 | 10/1981 | Inayama et al. | 219/10.55 R |
| 4,369,347 | 1/1983 | Shin | 219/10.55 B |
| 4,766,279 | 8/1988 | Park | 219/10.55 B |
| 4,777,575 | 10/1988 | Yamato et al. | 363/21 |
| 4,873,408 | 10/1989 | Smith et al. | 219/10.55 B |
| 4,888,461 | 12/1989 | Takano et al. | 219/10.55 B |
| 5,001,318 | 3/1991 | Noda | 219/10.55 B |
| 5,021,620 | 6/1991 | Inumada | 219/10.55 B |
| 5,091,617 | 2/1992 | Maechara et al. | 219/10.55 B |
| 5,120,916 | 6/1992 | Horinouchi et al. | 219/10.55 B |
| 5,132,503 | 7/1992 | Lee | 219/10.55 C |

*Primary Examiner*—Bruce A. Reynolds
*Assistant Examiner*—Tu Hoang
*Attorney, Agent, or Firm*—Wenderoth, Lind & Ponack

[57] ABSTRACT

A high frequency heating apparatus includes a unitary structure including a magnetron for generating a microwaves, an inverter power supply for supplying a high voltage electric power to the magnetron, and a cooling unit for cooling the magnetron and the inverter power supply, all of which are accommodated within a common metallic casing. The unitary structure is provided at least one of a detector for detecting an operating condition of the cooling unit and a safety device including a detector for detecting a mounting of the metallic casing to a cabinet. For avoiding an electric shock, the unitary structure is divided into high and low voltage portions and the magnetron and the inverter power supply are electrically connected directly to each other without relying on the unitary structure so as to thereby accomplish a structure effective to minimize noise and to improve the reliability and the safety factor.

7 Claims, 15 Drawing Sheets

HIGH FREQUENCY HEATING APPARATUS UTILIZING INVERTER POWER SUPPLY

BACKGROUND OF THE INVENTION

1. Field of the Invention

The present invention generally relates to a high frequency heating apparatus of a type utilizing dielectric heating for heating a dielectric material such as, for example, foods and, more particularly, to the high frequency heating apparatus utilizing an inverter power supply designed to convert into a high frequency alternating electric power a direct current electric power obtained by rectifying a commercial electric power.

2. Description of the Prior Art

One typical prior art high frequency heating apparatus will be discussed with reference to FIGS. 1 to 3. Referring first to FIG. 1 showing an electric circuit diagram of an electric power supply circuit used in the prior art high frequency heating apparatus, an electric power from a commercial electric power source 1 is rectified by a rectifier 2 into a direct current electric power which is subsequently supplied through a filtering circuit, including an inductor 3 and a capacitor 4, to semiconductor switching device 7 and also to a resonance circuit including a capacitor 5 and an inductor 6. The illustrated circuit employs a circuit design of a so-called "Isseki-type voltage resonating circuit". The inductor 6 concurrently serves as a primary winding of a transformer which includes, in addition to the primary winding 6, a secondary winding 8 for boosting a voltage applied to the primary winding 6 and a third winding 9 for lowering the voltage applied to the primary winding 6. A high voltage induced in the secondary winding 8 is rectified by a high voltage rectifying circuit 10 into a high direct current voltage. An electric power supply circuit comprising those elements as described above is hereinafter referred to as an inverter power supply 11.

The high D.C. voltage rectified by the high voltage rectifying circuit 10 is applied between an anode and a cathode of a magnetron 12 to excite the latter. A low A.C. voltage induced by the third winding 9 is applied to the cathode of the magnetron 12 to heat the cathode thereof. The magnetron 12 has an outer appearance such as shown in FIG. 2 and has the cathode constituted by a tungsten filament 13. The anode 14 of the magnetron 12 is constituted by a casing for the magnetron 12 and a space 15 between the cathode and the anode is highly evacuated to a substantial vacuum. The cathode 13 and the anode 14 are insulated from each other by means of a ceramic portion 16. The magnetron 12 can be oscillated to generate microwaves when a high voltage of about −4 kilovolts (assuming that the anode 14 is held at zero potential) is applied between the anode 14 and the cathode 13 and, also, the cathode is heated to a predetermined temperature.

Referring still to FIG. 1, a connection between the magnetron 12 and the inverter power supply 11 is carried out in the following manner. The cathode 13, which is a high voltage portion, and a high voltage side of the high voltage rectifying circuit 10 are connected together through an insulated wiring 17, but the anode 14, which is held at the zero potential, and a zero potential side of the high voltage rectifying circuit 10 are connected together through a chassis 18 of the high frequency heating apparatus, which chassis 18 is generally made of metal such as, for example, iron plate. FIG. 3 illustrates a mounting of both of the inverter power source 11 and the magnetron 12 on the chassis 18 of the high frequency heating apparatus. The high frequency heating apparatus so far shown in FIG. 3 comprises an oven-defining structure 19 having a heating chamber and an access opening leading into the heating chamber, a hingedly supported door 20 for selectively opening and closing the access opening, and a control panel 21. The microwaves generated by the magnetron 12 are radiated into the heating chamber of the oven-defining structure 19 to accomplish dielectric heating of, for example, food material placed within the heating chamber. While the cathode 13 which is the high voltage portion of the inverter power supply 11, and the high voltage side of the high voltage rectifying circuit 10 are connected together through the insulated wiring 17, the zero potential side of the high voltage rectifying circuit 10 is connected to the chassis 18 of the high frequency heating apparatus by means of a suitable connecting means 21 such as, for example, wiring, and also with the anode 14 through the chassis 18.

The chassis 18 of the high frequency heating apparatus has a propeller fan assembly 22 rigidly mounted thereon for cooling the magnetron 12 and the inverter power supply 11.

As hereinabove discussed, the prior art high frequency heating apparatus comprises the oven-defining structure, the chassis, the door, the control panel having a plurality of control elements for controlling the high frequency heating apparatus, the magnetron for generating the microwaves, the inverter power supply for driving the magnetron and the fan assembly for cooling both the inverter power supply and the magnetron. An assembly of the prior art high frequency heating apparatus has hitherto been carried out by the following manner. Those component parts described above are individually and sequentially mounted on the chassis by attendant workers and, thereafter, requisite electric connection between the inverter power supply and the control elements in the control panel and requisite electric connection between the inverter power supply and the magnetron are carried out. However, with the prior art high frequency heating apparatus of the above described construction, difficulties have been encountered in implementing the requisite electric connection, requiring a prolonged time to accomplish it. Also, since the inverter power supply, the magnetron and the fan assembly are individually and sequentially mounted on the chassis, an automatic mounting of those component parts is very difficult to accomplish.

In view of the foregoing, an attempt has been made to unite the inverter power supply, which is a microwave generating portion, the magnetron and the cooling means for cooling them into a unitary structure comprising a metallic housing. When they are accommodated in the metallic housing, a cooling system for cooling the magnetron and component parts comprising the inverter power supply can be mounted on a printed circuit board on which those component parts comprising the inverter power supply, and therefore, an electric power necessary to drive the cooling means can be supplied from the printed circuit board. Accordingly, it is possible to arrange the cooling means on the printed circuit board, and the electric power supply circuit and the cooling means can be connected together merely by dipping the printed circuit board in a solder bath, making it possible to substantially eliminate the need of manually accomplishing electric connections. A similar description can equally apply to the electric connection between the magnetron and the inverter power source.

As a metal forming the metallic housing for the unitary structure, aluminum can be employed because of its excellent property of shielding noise. The employment of aluminum brings about an additional advantage in that the use of a noise filter hitherto necessitated in the magnetron can be eliminated. Also, since the inverter power supply, the magnetron and the cooling means are united together, the mounting of the metallic housing including the inverter power source, the magnetron and the cooling means can be accomplished by the use of an automated mounting machine with the consequence that manual labor can be reduced effectively.

The size of the unitary structure and, hence, the metallic housing, is preferred to be small and the component parts forming the magnetron and the inverter power supply are arranged at a high density within the metallic housing. For this purpose, the fan assembly for forcibly cooling those component parts must be small in size, but capable of being highly resistant to a loss of pressure. One example of the fan assembly includes a generally cylindrical fan assembly known as Silocco fan, and a compact D.C. motor capable of being driven at a high speed is suited as a drive motor for driving the Silocco fan.

Such a unitary structure for generating microwaves has some problems peculiar to it. For example, countermeasures against microwave hazards are not sufficiently taken. The unitary structure for generating the microwaves can be driven to generate the microwaves when electrically connected to a commercial electric power outlet. Also, the unitary structure includes the cooling means such as the fan assembly, the microwaves once generated therefrom can leak to the outside for a long time even though it is not fitted to a body of the high frequency heating apparatus, thereby posing a problem associated with microwave hazards.

Also, since the component parts for the magnetron and the inverter power supply are highly densely arranged to make the resultant unitary structure compact, some component parts operable with high and low voltages, respectively, tend to be shortcircuited by some reason.

SUMMARY OF THE INVENTION

Accordingly, the present invention has been devised to provide an improved high frequency heating apparatus of a type in which an abnormality detecting means for detecting the presence or absence of an abnormal condition occurring in any of the component parts of the unitary structure so that the inverter power supply can be controlled in response to a signal from the abnormality detecting means so as to thereby avoid an occurrence of smoke and/or fire, and also to avoid a radiation of microwaves occurring in a space other than inside the heating chamber for the purpose of securing a safety factor.

Another important object of the present invention is to provide an improved high frequency heating apparatus of the type referred to above, wherein the magnetron and the inverter power supply, both accommodated within the metallic casing, are electrically connected directly with each other by the use of lead wires, copper plates or brass plates avoid the possibility that an electric current flowing between the magnetron and the inverter power supply will flow largely within the unitary structure, for the purpose of minimizing the emission of noise generated from the magnetron to the outside which would otherwise adversely affect electric appliances, communication appliances and/or medical appliances installed in the neighborhood of the high frequency heating apparatus.

A further important object of the present invention is to provide an improved high frequency heating apparatus of the type referred to above, wherein the high and low voltage portions are separated to avoid any possible contact therebetween so as thereby minimize any possible induction of the low voltage portion to the high voltage portion which would otherwise result in an electric shock.

BRIEF DESCRIPTION OF THE DRAWINGS

These and other objects and features of the present invention will become clear from the following description taken in conjunction with preferred embodiments thereof with reference to the accompanying drawings, in which like parts are designated by like reference numerals and in which.

DETAILED DESCRIPTION OF THE EMBODIMENT

Figure 4:
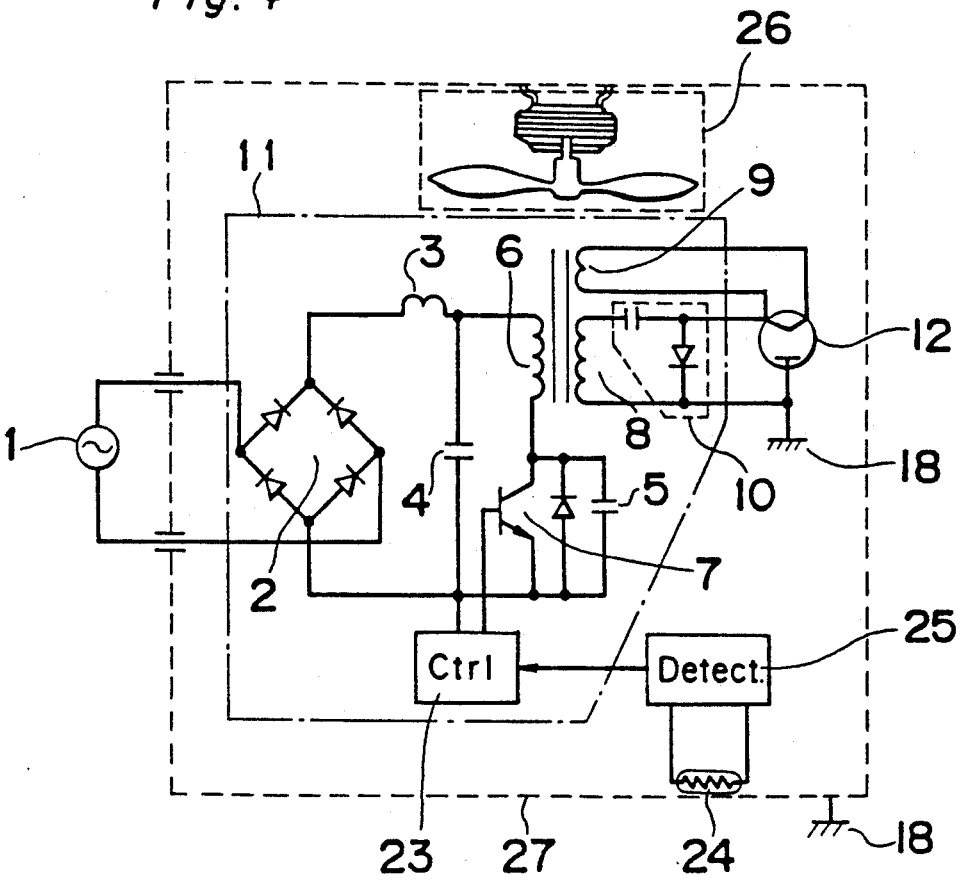
FIG. 4 is a schematic circuit diagram showing a unitary structure used in a high frequency heating apparatus according to a first preferred embodiment of the present invention.

Referring first to FIG. 4, there is shown a high frequency heating apparatus according to a first preferred embodiment of the present invention. Since FIG. 4 illustrates the circuit of a so-called "Zero-voltage switching resonance circuit", a control circuit 23 for controlling a semiconductor main switching device 7 is so designed as to perform a so-called pulse-width control (PWM control) so as to thereby control the inverter power supply 11. The inverter power supply 11, the magnetron 12 and the cooling means 26 for cooling both of the inverter power supply 11 and the magnetron 12 are accommodated within a metallic casing 27. The metallic casing 27 is provided with an abnormality detecting means 25 utilizing a thermistor 24 for detecting a temperature of the casing 27. When the temperature of the metallic casing 27 detected by the thermistor 24 reached a predetermined abnormal value, the abnormality detecting means 25 issue a signal to the control circuit 23 to cause the latter to control the semiconductor main switching device 7 in response to the signal so that the inverter power supply 11 can be brought to a halt or can have its output lowered.

Figure 5:
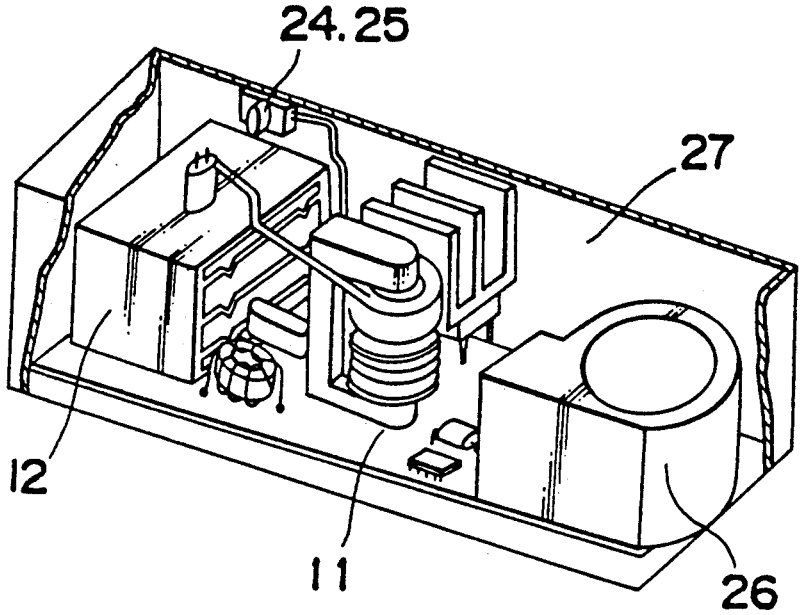
FIG. 5 is a schematic perspective view, with a portion cut away, of the unitary structure used in the high frequency heating apparatus.

FIG. 5 illustrates all of the inverter power supply 11, the magnetron 12 and the cooling means 26 accommodated within the metallic casing 27. As hereinbefore described, the cooling means 26 is mounted on the same printed circuit board as that on which the inverter power supply 11 is mounted and is employed in the form of a Silocco fan assembly capable of being highly resistant to a loss of pressure. The metallic casing 27 is made of aluminum having a high noise shielding property, on to which the abnormality detecting means 25 of the type employing the thermistor 24 is fitted. The metallic casing 27 is thermally coupled to the magnetron 12 through coupling members and fixtures and, therefore, the magnetron 12 may result in an abnormal oscillation known as "moding" accompanied by an elevation of temperature. Once this phenomenon occurs, the thermistor 24 is effective to detect it and, therefore, the abnormality detecting means 25 can issue a signal to the control circuit 23 to cause the latter to control the semiconductor main switching device 7 to bring the inverter power supply 11 to a halt.

Figure 6:
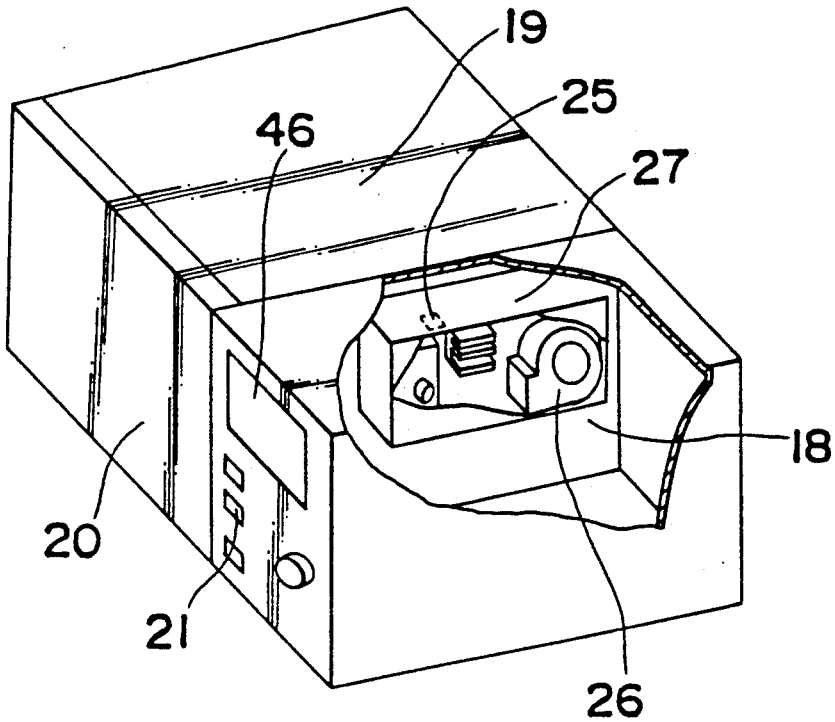
FIG. 6 is a schematic perspective view, with a portion cut away, of the high frequency heating apparatus in which the unitary structure is installed.

FIG. 6 illustrates the unitary structure (i.e., the metallic casing 27 having the inverter power supply 11, the magnetron 12 and the cooling means 26 accommodated therein) installed in the high frequency heating apparatus. As shown therein, the unitary structure is fitted to a chassis 18 forming a part of a cabinet 18 having a heating chamber defined therein for accommodating, for example, food material to be heated. Because of this, even though the temperature inside the cabinet 19 is abnormally elevated as a result of radiation of microwaves during a non-loaded condition of the cabinet 19, heat evolved in the chassis 18 is transmitted through the metallic casing 17, made of aluminum having a high thermal conductivity, to the abnormality detecting means 25 utilizing the thermistor 24 and, therefore, the inverter power supply 11 can be controlled so as to be brought to a halt or to have its output lowered. Accordingly, the possibility can be advantageously eliminated in which, in the event that the cabinet 19 is over-heated accompanied by the elevation of temperature of the chassis 18 and that of air in the vicinity of the chassis 18, air supplied by the cooling means 26 may be increased in temperature, resulting in an increase in temperature of the various component parts including the inverter power supply 11 to be cooled. This elimination of the possibility makes it possible to increase the reliability of the system of the present invention.

Figure 7:
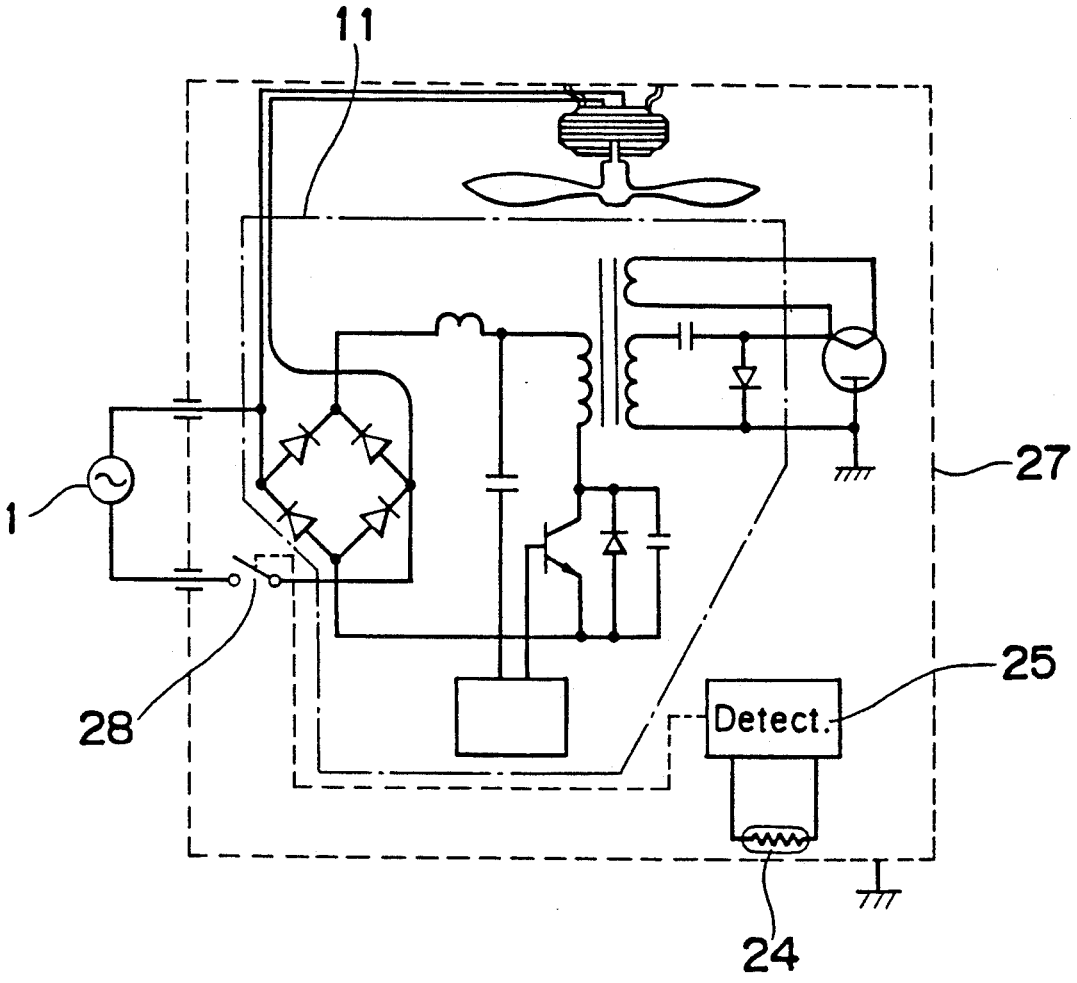
FIGS. 7 to 9 are diagrams similar to FIG. 4, showing second, third and fourth preferred embodiments of the unitary structure, respectively.

FIG. 7 illustrates the unitary structure in the high frequency heating apparatus according to a second preferred embodiment of the present invention. For the purpose of detecting an abnormal increase in temperature of the metallic casing 27, the abnormality detecting means 25 utilizing the thermistor 24 is employed and, at the same time, a switching means 28 such as a relay assembly is employed in a power supply line extending between the commercial electric power source 1 and the inverter power supply 11. The switching means 28 is operable in the response to the signal from the abnormality detecting means 25 to interrupt the supply of an A.C. electric power from the source 1 to the inverter power supply 11 in the event of the abnormal increase in temperature of the metallic casing 27.

Figure 8:
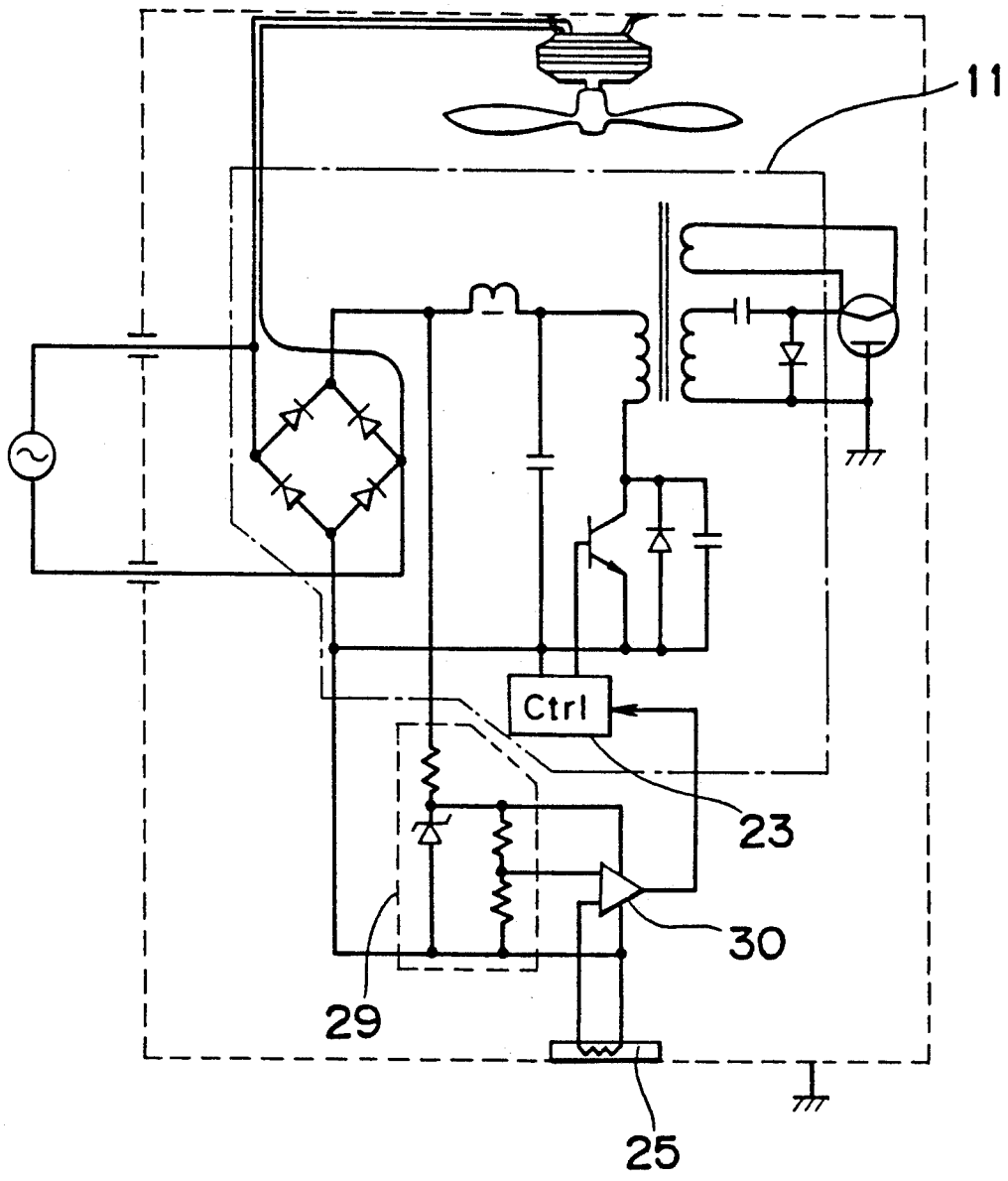

FIG. 8 illustrates the unitary structure in the high frequency heating apparatus according to a third preferred embodiment of the present invention. The unitary structure shown therein makes use of the abnormality detecting means 25 for detecting the abnormal increase in temperature of the metallic casing 27, a reference level generating means 29, and a comparing means 30 for comparing the signal from the abnormality detecting means 25 with a reference level generated by the reference level generating means 29. Since the abnormality detecting means 25 outputs the signal of a level proportional to the temperature of the metallic casing 27, the following method may be employed to bring the inverter power supply 11 to a halt when the temperature of the metallic casing 27 reaches a predetermined value. Specifically, the reference level generating means 29 generates a reference signal of a reference level equal to the level of the signal which is outputted from the abnormality detecting means when the temperature of the metallic casing 27 attains the predetermined value at which the inverter power supply 11 is desired to be brought to a halt, and the reference signal from the reference level generating means 29 can be compared by the comparing means 30 with the signal from the abnormality detecting means 25. Should the level of the signal from the abnormality detecting means 25 exceed the reference level, the comparing means 30 applied a signal to the control circuit 23 to cause the latter to control the semiconductor main switching device 7 to being the inverter power supply 11 to a halt. As in FIG. 7, the signal from the comparing means 30 may alternately be applied to a switching means 28, disposed on a power supply line leading to the inverter power supply 11, so that the switching means 28 can operate in response to the signal from the comparing means 30 to interrupt the supply of the electric power from the inverter power supply 11 to the magnetron 12.

Figure 9:
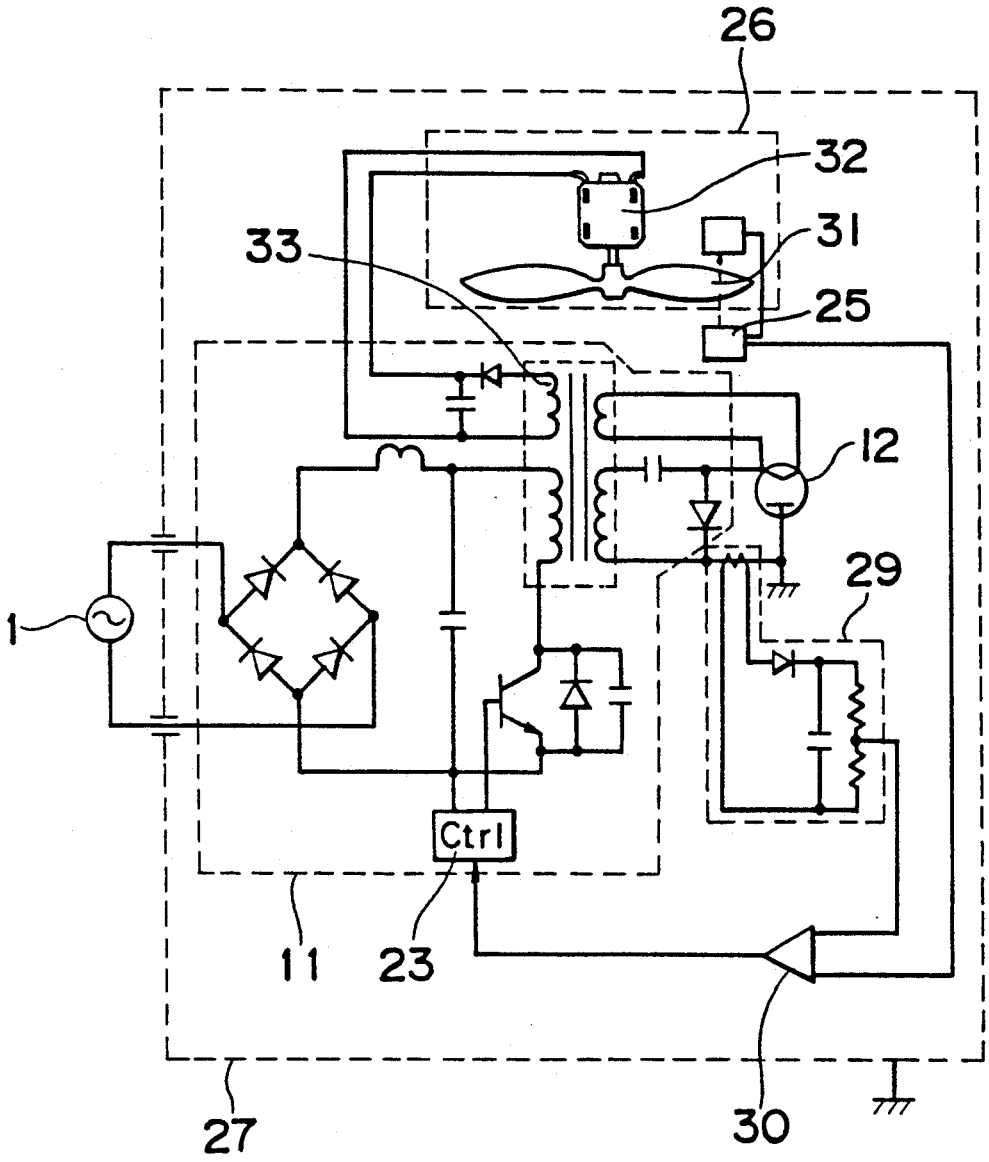

FIG. 9 illustrates the unitary structure in the high frequency heating apparatus according to a fourth preferred embodiment of the present invention. The reference level generating means 29 shown therein comprises a current transformer for detecting the magnitude of an output current from the inverter power supply 11, a rectifying circuit for rectifying an output from the current transformer, and resistors. This reference level generating means 29 is so designed that the reference level generated thereby can vary according to the output from the inverter power supply 11. In other words, a lowering of the output from the inverter power supply 11 results in a corresponding lowering of the reference level.

In the embodiment shown in FIG. 9, the abnormality detecting means 25 for detecting an abnormal condition occurring in any one of the component parts of the unitary structure is utilized to detect the rotation of a fan assembly 31 which is used to cool the inverter power supply 11 and the magnetron 12.

It may occur that, in the event that the rotation of the fan assembly 31 is considerably lowered or stopped for some reason, the temperature of the component parts forming the unitary structure within the metallic casing 27 will abnormally increase. As hereinbefore described, a direct current motor 32 is employed for driving the fan assembly 31 in order to secure a compact feature and a high speed drive. For driving the direct current motor 32, a low D.C. voltage of about 10 watts is required and, if an arrangement is made to obtain this D.C. electric power for driving the motor 32 from the commercial electric power outlet 1, a circuit for rectifying the commercial electric power into the D.C. power of low voltage will become bulky and complicated in structure.

In order to substantially eliminate this problem, as shown in FIG. 9, a transformer included in the inverter power supply 11 is provided with a winding 33 for extracting an A.C. electric power and rectifying it into a D.C. electric power. The A.C. electric power induced from the winding 33 of the transformer in the inverter power supply 11 is of a frequency considerably higher than that of the commercial electric power outlet and, therefore, an inductor for the winding 33 and a capacitor for rectifying the A.C. electric power of high frequency can be compact in size, making it possible to render a circuit for providing the D.C. electric power to be compact. However, the output from the winding 33 equally varies with the output from the inverter power supply 11. That is, when the output from the inverter power supply 11 lowers, the output from the winding 33 lowers correspondingly and, as a result thereof, the rotational speed of the fan assembly 31 is decreased. The lowering of the output from the inverter power supply 11 also result in a reduction in loss of the component parts such as the semiconductor switching element, capacitors and inductors used in the inverter power supply 11. Accordingly, it may occur that the problem may be negligible since, even though the output from the inverter power supply 11 is lowered, accompanied by a reduction in cooling efficiency of the fan assembly 31 due to the reduction in the rotational speed thereof, the loss of the component parts can be reduced. Therefore, the reference level of the reference level generating means 29 with which the level of the signal obtained from the abnormality detecting means 25 for detecting the presence or absence of the abnormal condition occurring in the component parts is compared is made variable with the output from the inverter power supply 11.

Thus, since the reference level of the reference level generating means 29 lowers when the output from the inverter power supply 1 is lowered, accompanied by a lowering of the rotational speed of the fan assembly 31 which is in turn accompanied by a lowering of the level of the signal generated from the abnormality detecting means 25, the comparing means 30 for comparing the signal from the abnormality detecting means with the reference level will not output any signal necessary to bring the control circuit 23 into an inoperative position and, therefore, the operation of the inverter power supply 11 is possible even at a lowered output.

Figure 10:
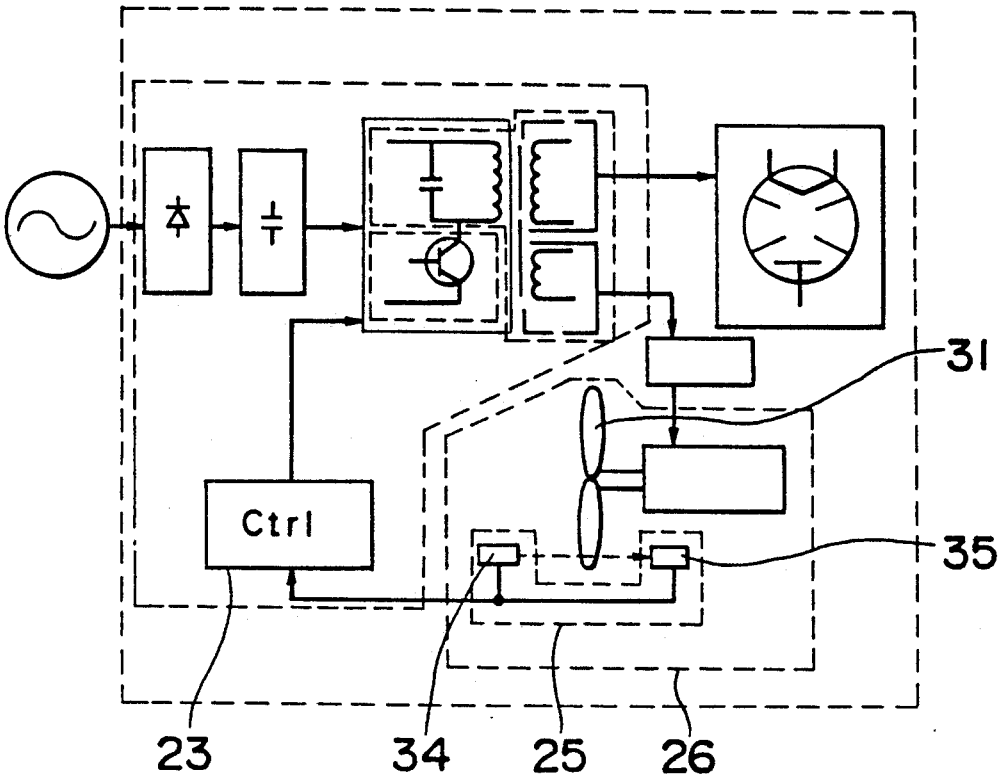
FIG. 10 is a block circuit diagram showing the unitary structure according to a fifth preferred embodiment of the present invention.

FIG. 10 illustrates an embodiment in which the abnormality detecting means 25 is designed to detect the rotational speed of the fan assembly 31 of the cooling means 26. As shown herein, the abnormality detecting means 25 comprises a light emitting diode 34 and a phototransistor 35 having its output fed to the control circuit 23 as the output of the abnormality detecting means 25, so that the control circuit 23 can control the inverter power supply 11 in such a way as to bring it to a halt or as to generate a controlled output. The abnormality detecting means 25 comprised of the light emitting diode 34 and the phototransistor 35 is specifically constructed as shown in FIG. 11.

Figure 11:
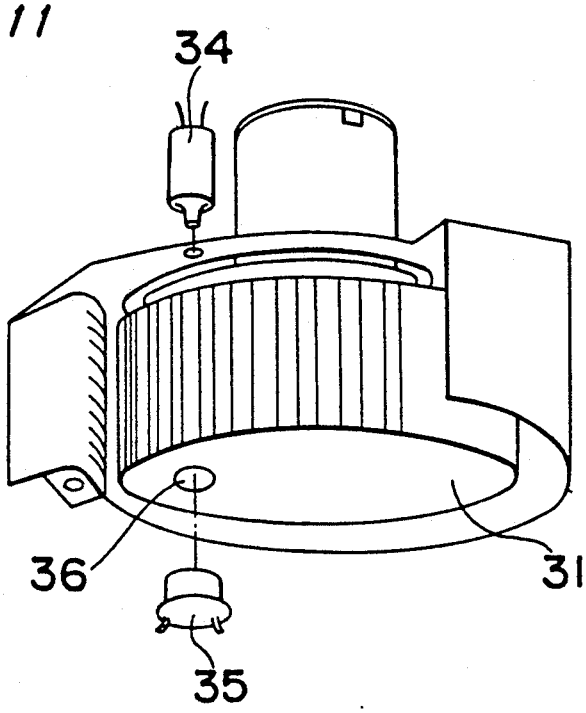
FIG. 11 is a schematic perspective view of a fan assembly used in the high frequency heating apparatus of the present invention, showing one embodiment of a fan drive detecting means.

Referring to FIG. 11, the light emitting diode 34 and the phototransistor 35 are positioned in alignment with each other and on respective sides of the fan assembly 31 having a through-hole 36 defined therein for the passage of rays of light therethrough from the light emitting diode 34 towards the phototransistor 35. Since the through-hole 36 suffices for the passage of the light rays therethrough from the light emitting diode 34 towards the phototransistor 35, means may be provided in the fan assembly for avoiding any possible leakage of air and also for reducing noise such as a flying or roaring sound. One example of this means may be the use of plugs made of transparent material such as, for example, glass frits.

In this system, the phototransistor 35 outputs a high level signal in response to receipt of the light rays from the light emitting diode 34 and a low level signal when the passage of the light rays from the light emitting diode 34 towards the phototransistor 35 is intercepted during the revolution of the fan assembly 31. Accordingly, during the continued rotation of the fan assembly 31, the phototransistor 35 can generate a signal of a period proportional to the number of rotations of the fan assembly 31. The abnormality detecting means 25 includes a voltage-frequency converter for converting the signal of a predetermined cycle into a voltage of a predetermined value proportional to the period so that the voltage proportional to the number of rotations of the fan assembly 31 can be supplied to the control circuit 23. With this construction, the presence or absence of an abnormal condition in the rotational speed of the fan assembly 31 can be detected by detecting the rotational speed of the fan assembly 31 by means of the abnormality detecting means 25 and, therefore, the inverter power supply 11 can be brought to a halt immediately when the rotational speed of the fan assembly 31 is considerably reduced by some reason.

Figure 12A:
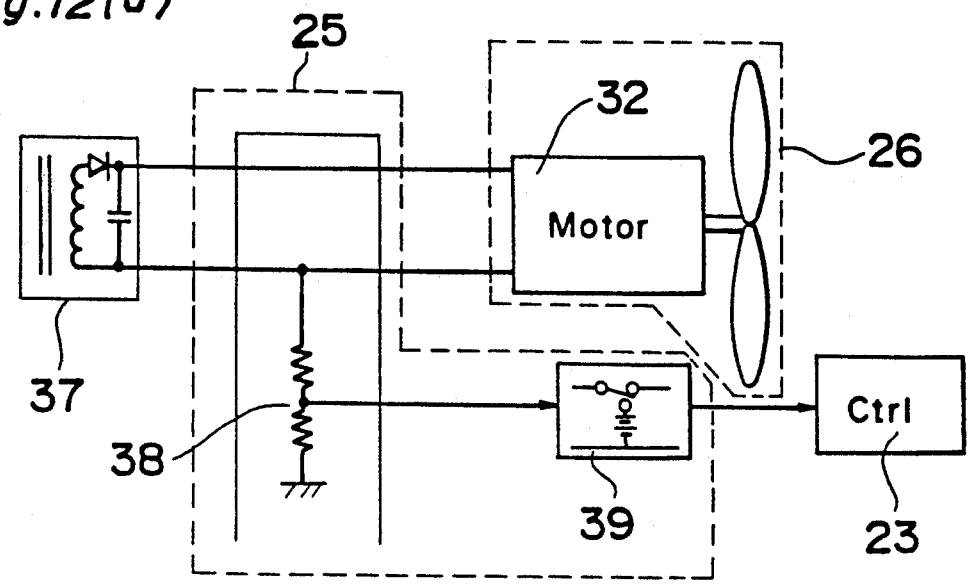
FIGS. 12(*a*)–12(*c*) are diagrams showing another embodiment of the fan drive detecting means.
Figure 12B:
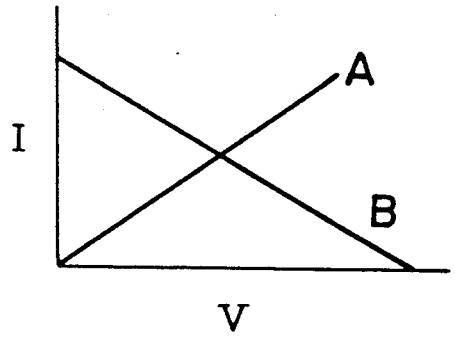
Figure 12C:
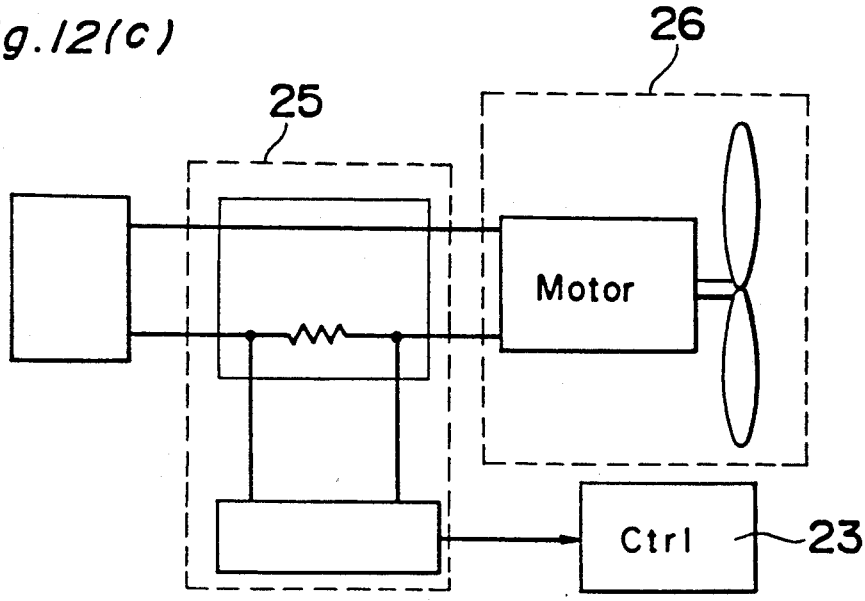

The abnormality detecting means 25 for detecting the presence or absence of the abnormal condition in the cooling means 26 may be constructed in numerous ways. One example thereof is shown in FIGS. 12(*a*)–12(*c*). Referring first to FIG. 12(*a*), the abnormality detecting means 25 comprises a timer circuit 39 and a resistor 38 for detecting the voltage of a direct current source 37 for supplying an electric power to the D.C.

motor 32. As hereinbefore described, the direct current source 37 for driving the D.C. motor 32 is of a design wherein the transformer in the inverter power supply 11 is provided with the winding 33 from which the A.C. power of high frequency can be obtained and is rectified into the D.C. power. In view of this, a voltage-current characteristic of the D.C. motor 32 is of a relationship such as shown by a line A in FIG. 12(*b*). Also, an output characteristic of the direct current source 37 is of a relationship such as shown by a line B in FIG. 12(*b*). In other words, if a load current is drawn in a great amount, the voltage generated tends to be lowered. If the D.C. motor 32 is locked by some reason, a relatively large amount of electric current flow across the D.C. motor 32 with the load current of the direct current source 37 consequently increased, and as a result thereof, the voltage generated from the direct current source 37 decreases. On the other hand, if the load on the direct current source 37 approaches a non-loaded condition by reason of, for example, a line breakage of the D.C. motor 32, the load current will decrease extremely accompanied by an increase in voltage generated from the D.C. motor 32.

Accordingly, the detection of the voltage to be applied to the D.C. motor 32 makes it possible to detect the presence or absence of the abnormal condition occurring in the D.C. motor 32. The timer circuit 39 provided in the abnormality detecting means 25 is operable to inhibit an application of the signal from the abnormality detecting circuit 25 to the control circuit 23 during an unstable period which lasts for a few seconds subsequent to the start of operation of the inverter power supply 11.

Referring now to FIG. 12(*c*), the abnormality detecting means 25 comprises the resistor for detecting the electric current of the direct current source 37 for supplying an electric power to the D.C. motor 32, and the timer circuit. As hereinbefore described, the electric current flowing across the D.C. motor 32, that is, the load current of the direct current source 37, is variable with a condition of the D.C. motor 32. Accordingly, the detection of the load current referred to above makes it possible to detect an operating condition of the cooling means 26. As is the case with means for detecting the voltage to be applied to the D.C. motor 32 as hereinbefore discussed, the output signal from the abnormality detecting means is supplied to the control means 23 to control the inverter power supply 11.

Figure 13:
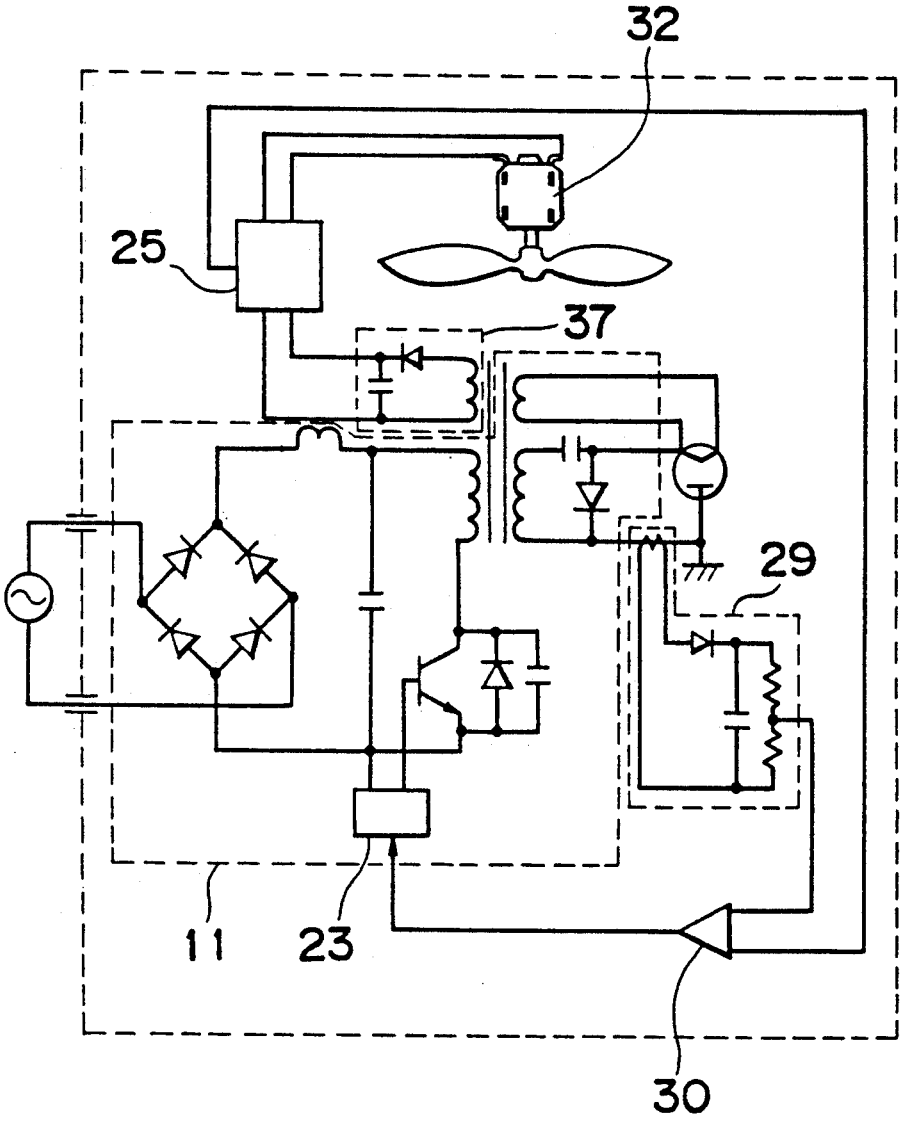
FIG. 13 is a diagram similar to FIG. 4, showing a sixth preferred embodiment of the unitary structure.

Referring now to FIG. 13, there is shown a circuit which comprises the abnormality detecting means 25 for detecting the voltage or current from the direct current source 37 for supplying an electric power to the D.C. motor 32, the reference level generating means 29 for detecting the output from the inverter power supply 11 and for generating the reference level and the comparing means 30 for comparing the output from the abnormality detecting means 25 with the reference level and for supplying an output to the control means 23 to control the inverter power supply 11. With this circuit, it is possible to make the reference level variable with the output from the inverter power source 11 and, therefore, the inverter power supply 11 can operate at a low output.

Figure 14:
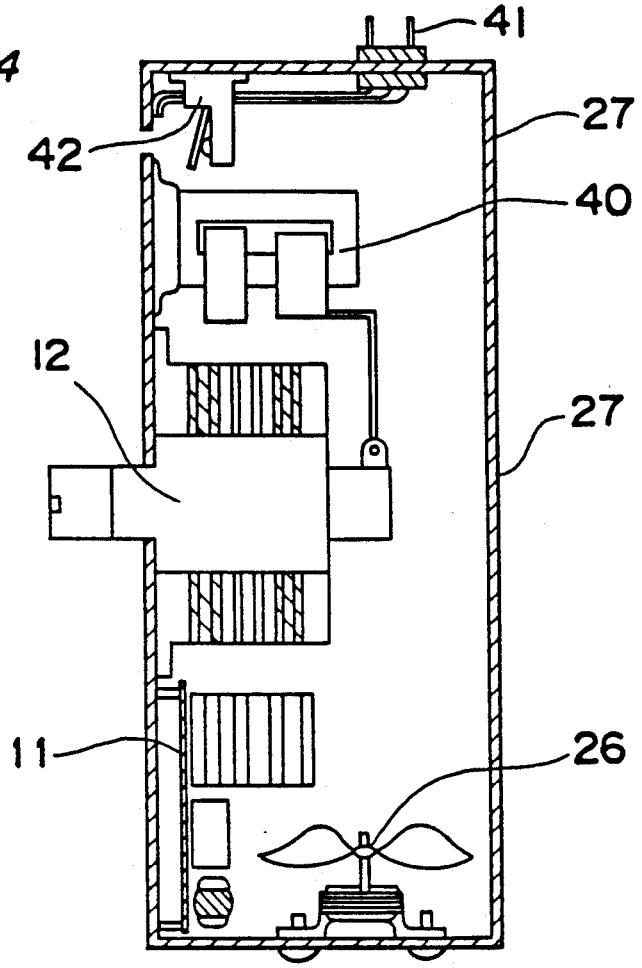
FIG. 14 is a side sectional view of the unitary structure.

FIG. 14 illustrates the unitary structure including the metallic casing 27 accommodating therein the inverter power supply 11, the magnetron 12, a transformer 40 forming a part of the inverter power supply 11, the cooling means 26 for cooling those component parts, terminals 41 adapted to be connected with the commercial electric power outlet and through which an electric power can be supplied to the inverter power supply 11, and a detecting means 42 comprising a latch switch for detecting whether or not the metallic casing 27 is fitted to the cabinet 19.

Figure 15A:
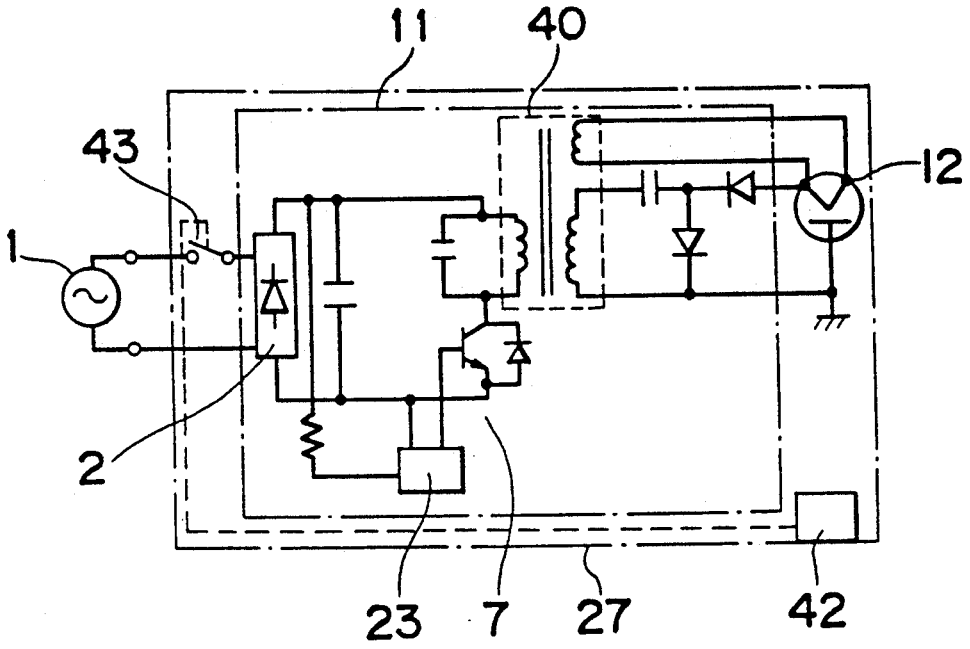
FIGS. 15(*a*)–15(*b*) are diagrams similar to FIG. 4, showing a seventh preferred embodiment of the unitary structure.
Figure 15B:
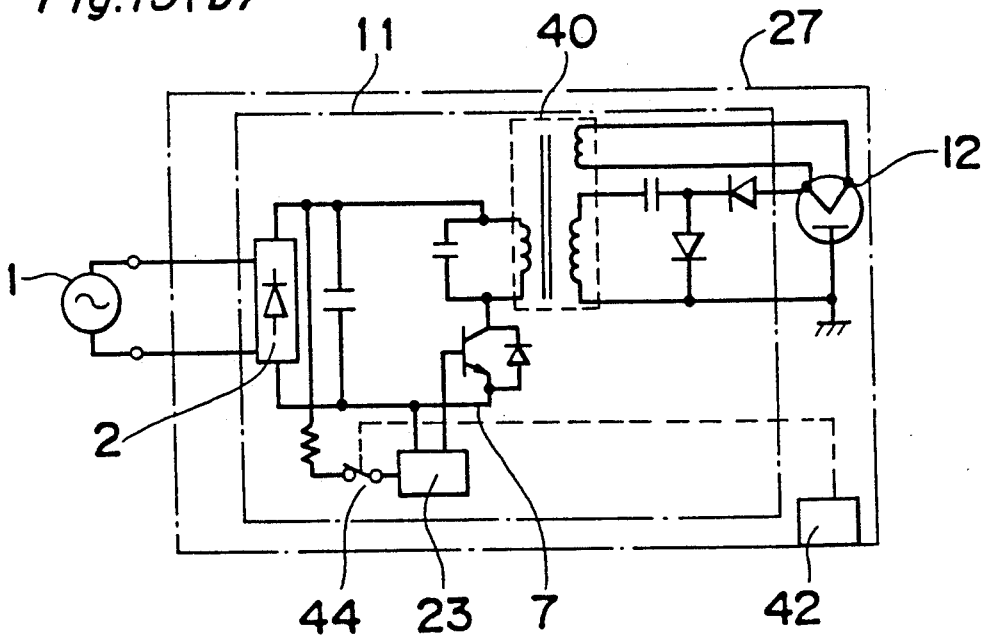

FIGS. 15(*a*)–15(*b*) illustrate an electric circuit of the inverter power supply forming a part of the unitary structure shown in FIG. 14. It is, however, to be noted that, for the purpose of brevity, the cooling means is not shown in FIGS. 15(*a*)–15(*b*).

Referring to FIGS. 15(*a*)–15(*b*) the inverter power supply 11 adapted to receive the electric power from the commercial power outlet is used to generate a high voltage necessary to urge the magnetron 12. The magnetron 12 generates a microwave which is subsequently guided into the cabinet 19 to accomplish the dielectric heating of, for example, food material within the cabinet 19.

The inverter power supply 11 comprises the rectifier 2, the transformer 40, the semiconductor switching element 7, and the control circuit 23 for driving the semiconductor switching element 7.

An abnormality detecting means 42 as shown in FIG. 15(*a*) is used to detect whether or not the metallic casing 27 is fitted to the cabinet 19 and applied a signal to a switching means 43 disposed on a power supply line through which the electric power can be supplied from the commercial power source 1 to the inverter power supply 11. In this construction, in the event that the casing 27 has not yet been fitted to the cabinet 19, the abnormality detecting means 42 detects a non-fitted condition of the casing 27 and generates a signal to the switching means 43 to open the latter with the supply of the electric power from the source 1 to the supply 11 interrupted consequently. As shown in FIG. 15(*b*), a switching means 44 is disposed on a power supply line through which an electric power can be supplied to the control circuit 23 and, as is the case with FIG. 15(*a*), the abnormality detecting means 42 when detecting the non-fitted condition of the casing 27 generates a signal to the switching means 44 to open the latter with the supply of the electric power to the control circuit 23 interrupted consequently and, therefore, the inverter power supply 11 does not operate.

Since a relatively high electric current of about 10 amperes flows through the power supply line leading to the inverter power supply 11, the latch switch used for the switching means 43 shown in FIG. 15(*a*) must be of a type having a large capacity. In contrast thereto, although the switching means 44 shown in FIG. 15(*b*) is disposed on the power supply line leading to the control circuit 23, the control circuit 23 requires a considerably low electric power to operate and an electric current of a few hundred milliamperes flows through the power supply line leading to the control circuit 23. Therefore, the latch switch used for the switching means 44 shown in FIG. 15(*b*) may be of a type having a small capacity.

Figure 16:
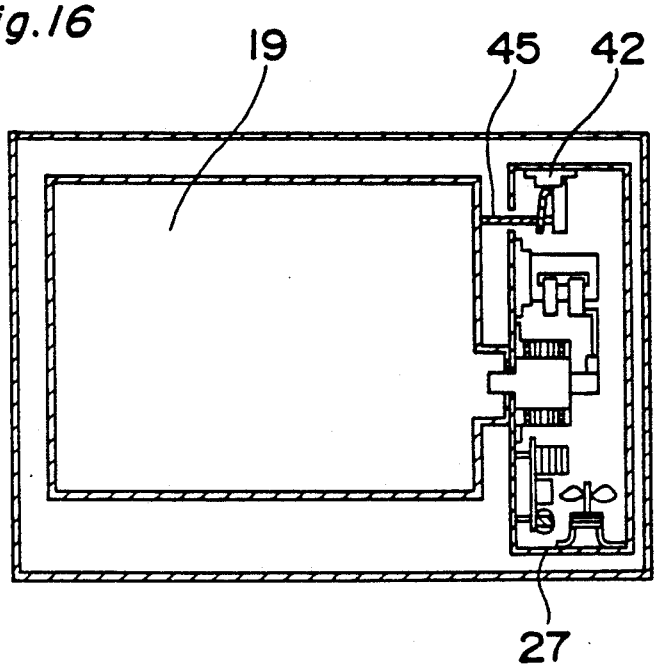
FIG. 16 is a schematic sectional view of the high frequency heating apparatus in which the unitary structure of FIG. 15 is installed.

FIG. 16 illustrates, in sectional representation, the cabinet 19 to which the casing 27 is fitted. The cabinet 19 is provided with a projection 45 which serves as a check means for ascertaining a proper fitting of the casing 27 to the cabinet 19. The unitary structure shown therein makes use of the abnormality detecting means 42, accommodated therein, in combination with the check means to detect whether or not the casing 27 has been properly fitted to the cabinet 19. In other words, if the casing 27 is fitted to the cabinet 19, the projection 45 integral or fast with the cabinet 19 presses a latch switch which is used as the abnormality detecting means 42 forming a part of the unitary structure accommodated within the casing 27.

Figure 17:
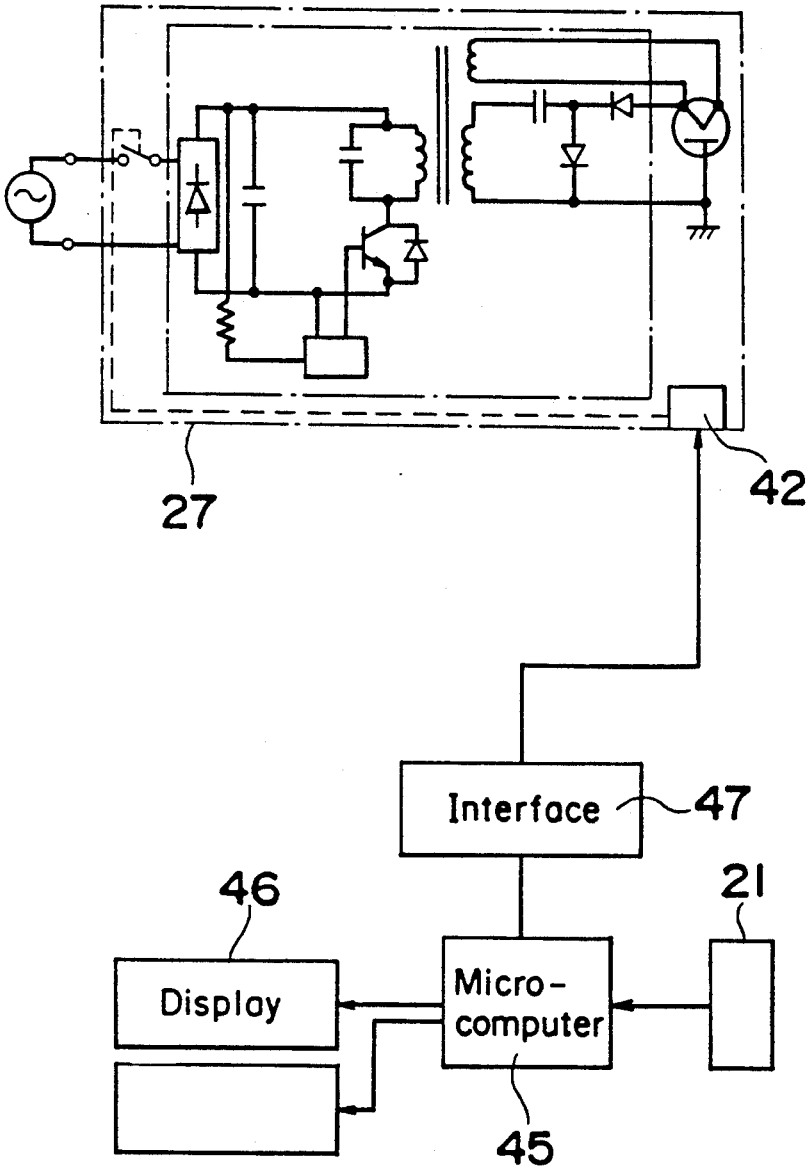
FIG. 17 is a diagram similar to FIG. 4, showing an eighth preferred embodiment of the unitary structure.

While the check means shown in FIG. 16 has been described as comprised of a mechanical element, that is, the projection 45 fast or integral with the cabinet 19, FIG. 17 illustrates the use of an electric means for the check means.

Referring now to FIG. 17, a microcomputer 45 is adapted to control a display unit 46, etc., in response to an input signal supplied from the control panel 21 provided in the high frequency heating apparatus. If the casing 27 is fitted to the cabinet 19 and an interface means 47 between the microcomputer 45 and the unitary structure in the casing 27 is coupled, the abnormality detecting means 42 in the unitary structure can receive output signals from the microcomputer 45. Therefore, the abnormality detecting means 42 can detect whether or not the casing 27 has been fitted to the cabinet 19.

The foregoing design can bring about the following advantages.

The provision of the abnormality detecting means for detecting whether or not the casing has been fitted to the cabinet and the switching means adapted to be operated by said means to control the operation of the inverter power supply makes it possible for the abnormality detecting means to detect whether or not the casing has been fitted to the cabinet and, in the event that it has not been fitted, the abnormality detecting means operates the switching means for controlling the inverter power supply thereby to bring the inverter power supply into the inoperative position.

The provision of the check means by which it can be ascertained if the casing including the unitary structure is fitted to the cabinet makes it possible for the abnormality detecting means and the check means to determine whether or not the casing has been fitted to the cabinet so that the operation of the inverter power supply can be controlled.

Because of the foregoing, the possibility can be advantageously eliminated in which microwaves are radiated with the commercial power source erroneously connected to the terminal on the casing while the casing has not been fitted to the cabinet, thereby securing a high safety factor.

Figure 18:
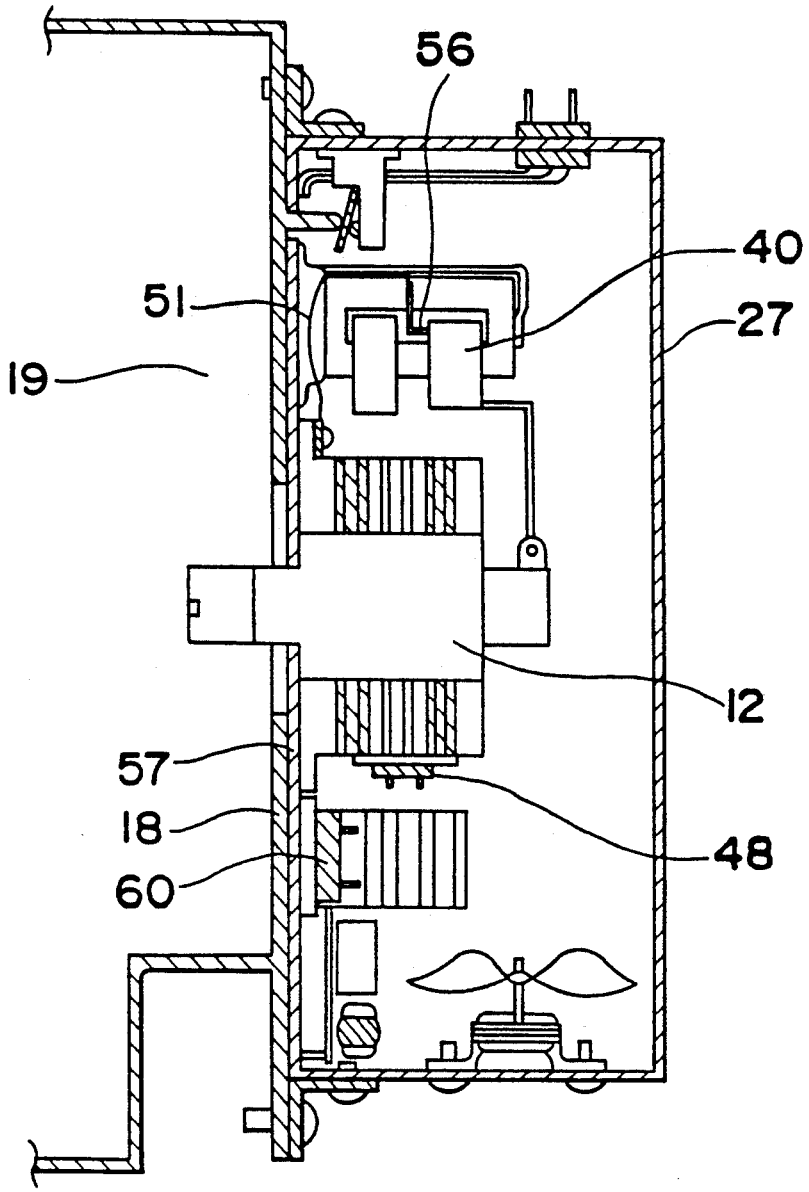
FIG. 18 is a fragmentary sectional view of the unitary structure.

FIG. 18 illustrates the unitary structure wherein an abnormality detecting means 48 is used to detect the temperature of the magnetron 12, which means 48 employs a thermistor for detecting the temperature of the anode of the magnetron 12. The magnetron 12 is of the construction shown in and described with reference to FIG. 2, and the abnormal oscillation known as "moding" may occur in the magnetron 12 when the cathode 13 thereof is deteriorated. Since the moding is not a normal oscillation, the frequency of oscillation deviates from about 2.45 GHz which is a normal oscillating frequency. Accordingly, microwave energies generated from the magnetron 12 will not be transmitted to the outside of the magnetron 12 and are consumed within the magnetron 12 for transformation into heat. Because of this, the temperature of the anode 13 of the magnetron 12 increases and, in the worst case it may happen, such a hazardous condition in which the anode 14 melts will occur.

To avoid the foregoing possibility, the use is made of the abnormality detecting means 48 for detecting the temperature of the anode 14 so that, in the event that the temperature of the anode 14 becomes equal to or higher than a predetermined value, the abnormality detecting means 48 can provide a signal which is subsequently utilized to stop the operation of the inverter power supply 11, thereby to preventing the anode 14 from being melt.

Figure 1:
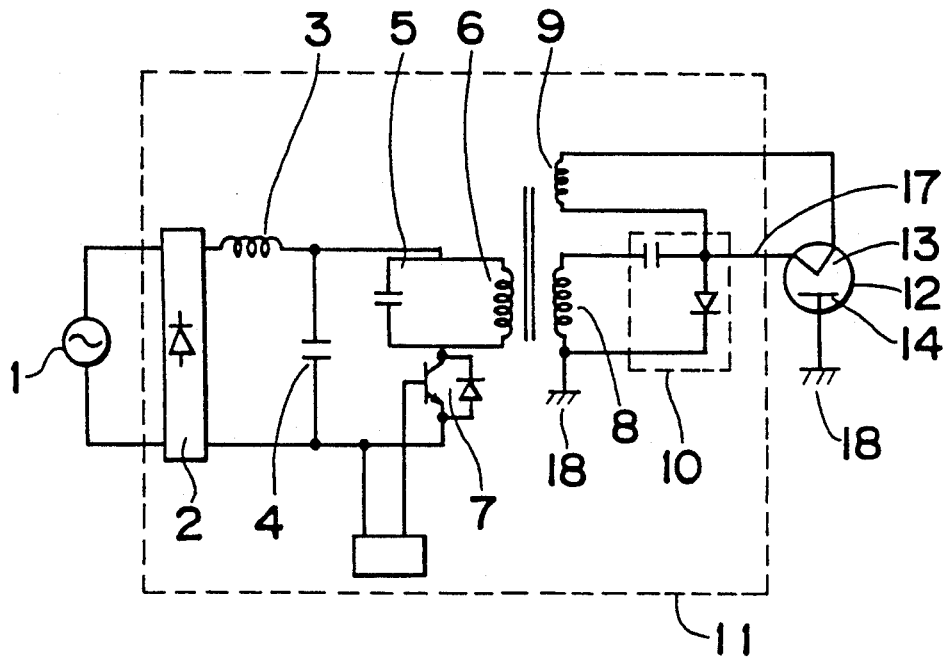
Fig. 1 PRIOR ART
FIG. 1 is a schematic circuit diagram showing an inverter power supply used in the prior art high frequency heating apparatus.
Figure 2:
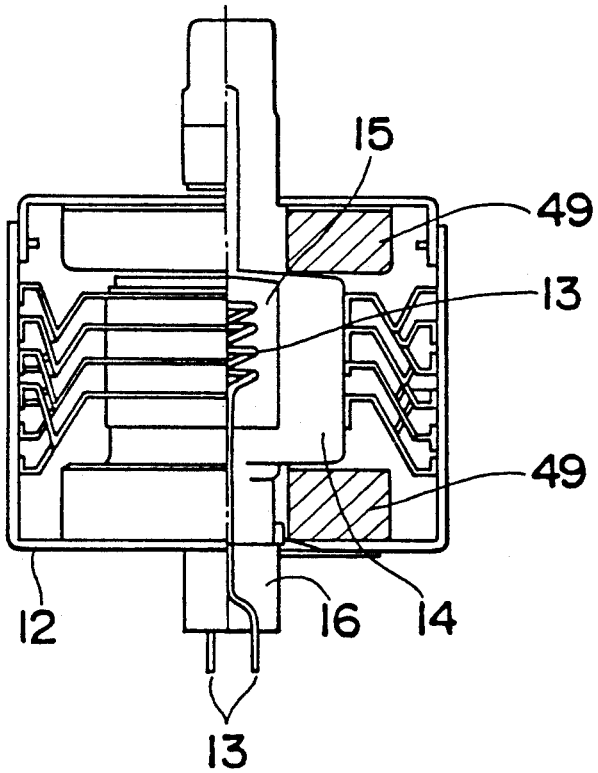
Fig. 2 PRIOR ART
FIG. 2 is a side sectional view showing the magnetron.
Figure 3:
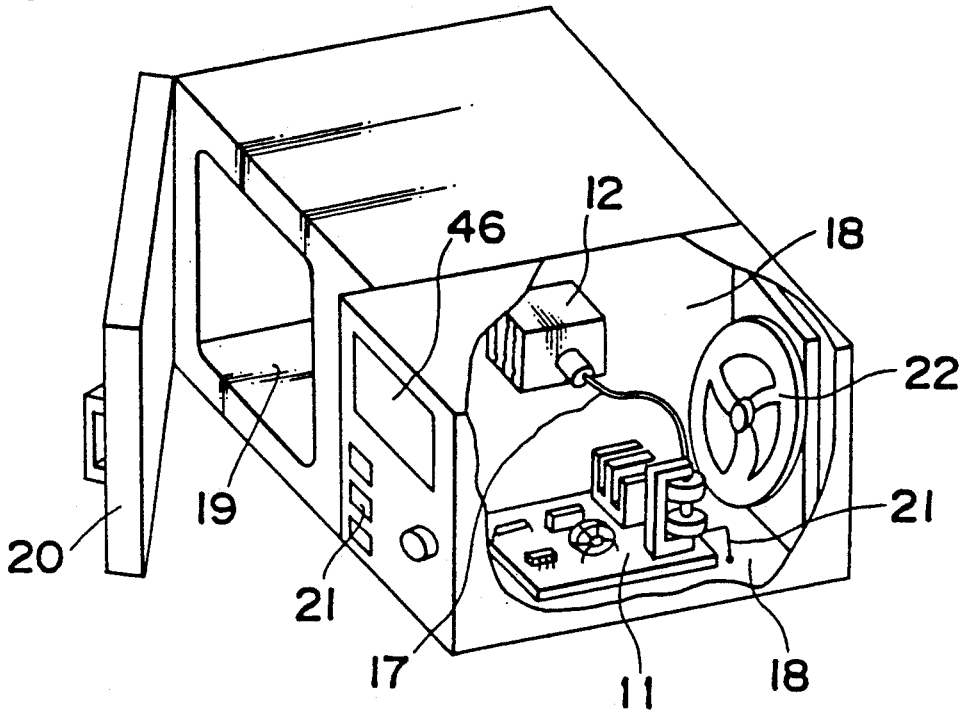
Fig. 3 PRIOR ART
FIG. 3 is a schematic perspective view, with a portion cut away, of the prior art high frequency heating apparatus.

As shown in FIG. 2, the magnetron 12 makes use of a magnet 49. This magnet 49 has a temperature characteristic and has a magnetic permeability which decreases with increase in temperature thereof. Because of this, an operating voltage of the magnetron 12, that is, a voltage to be applied between the anode 14 and the cathode 13 during an oscillation of the magnetron 12, tends to be lowered. Once the operating voltage of the magnetron 12 decreases, the inverter power supply 11 will be adversely affected as follows.

Specifically, the electric current flowing through the semiconductor main switching element 7 of the inverter power supply 11 increases and, as a result thereof, a loss of the semiconductor main switching element 7 increases. While the reduction in operating voltage of the magnetron 12 adversely affects the semiconductor main switching element 7 in the manner described above, a considerable reduction in operating voltage of the magnetron 12 may take place when the high frequency heating apparatus is operated for a long length of time under a non-loaded condition in which no material to be heated is accommodated within the cabinet, or under a low-loaded condition in which the amount of material to be heated within the cabinet is extremely small. In view of this, the abnormality detecting means 48 detects an abnormal increase in temperature of the anode 14 of the magnetron 12 so that a signal can be applied therefrom to the control circuit 23 operable to control the semiconductor main switching element 7, thereby to reducing the output from the inverter power supply 11. By so doing, it is possible to avoid the abnormal increase of the temperature of the magnetron 12 and/or the semiconductor main switching element 7.

Referring still to FIG. 18, a further embodiment will now be described. An abnormality detecting means 60 for detecting the temperature of the magnetron 12 is fitted to a wall face 57 of the casing 27 which is adapted to be held in contact with the cabinet 19 when the casing 27 is fitted to the latter. Since the cover 57 of the casing 27 is made of aluminum which has a high thermal conductivity, heat evolved in the magnetron 12 and that in the chassis 18 forming the cabinet 19 are transmitted through the aluminum cover 57 and, therefore, both of the temperature of the magnetron 12 and that of the cabinet 19 can be detected simultaneously. Accordingly, even when the material to be heated inside the cabinet 19 burns and/or the cabinet 19 is abnormally heated, the inverter power supply 11 can be brought to a halt or have its output regulated.

Figure 19:
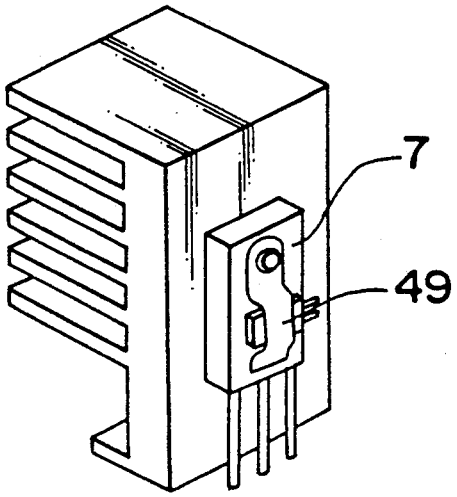
FIG. 19 is a schematic perspective view showing an installation of an abnormality detecting means to a semiconductor switching element.

FIG. 19 illustrates an example wherein, as the abnormality detecting means 49, a detecting means for detecting the temperature of the semiconductor main switching element 7 of the inverter power supply 11 is employed. The loss of the semiconductor main switching element 7 varies with the operating condition of the magnetron 12 as hereinbefore described. Therefore, if the abnormality detecting means 49 is used to detect the temperature of the semiconductor main switching element 7 and then to provide information to the control circuit 23 for controlling the semiconductor main switching element 7 to control the inverter power supply 11 in such a way as to bring the inverter power supply 11 to a halt or as to cause the latter to generate a lowered output, any possible abnormal increase in temperature of the magnetron 12 and/or the semiconductor main switching element 7 can be avoided.

Figure 20:
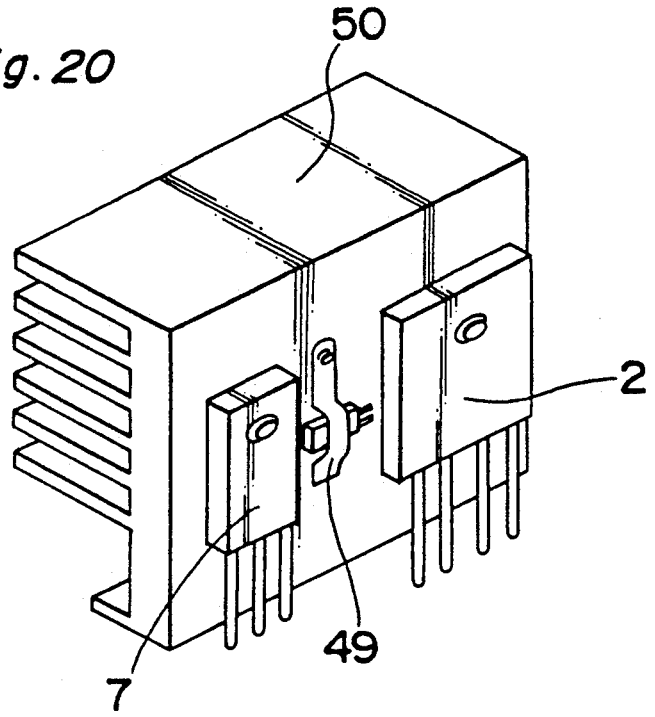
FIG. 20 is a schematic perspective view showing an installation of an abnormality detecting means to a fin to which a semiconductor switching element is fitted.

FIG. 20 illustrates the semiconductor main switching element 7 and another element such as, for example, the rectifier 2, which are installed on a heat radiating fin assembly 50. The abnormality detecting means 40 for detecting the temperature of them is also fitted to the fin assembly 50. According to the structure shown in FIG. 20, a single abnormality detecting means 49 can be utilized to detect an increase in temperature of the plural elements.

Figure 21:
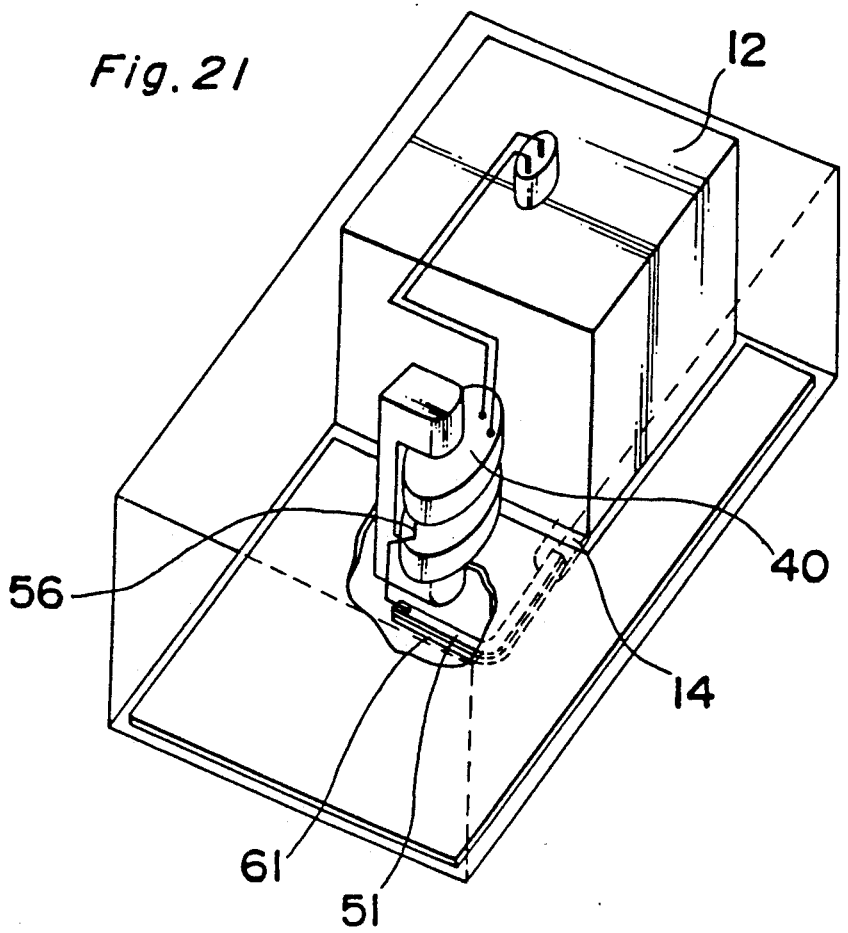
FIG. 21 is a schematic perspective view of a ninth preferred embodiment of the unitary structure.

FIG. 21 illustrates a schematic perspective view of the casing 27 with the unitary structure accommodated therein, it being however to be noted that, for the sake of brevity, only the printed circuit board, the aluminum casing 27, the magnetron 12 and the transformer 40 are shown. According to FIG. 21, a winding terminal 56 of a zero potential side of the secondary winding of the transformer 40 forming a part of the inverter power supply 11 operable to urge the magnetron 12 is electrically connected with the anode 14 of the magnetron 12 directly through a plate 51 made of brass. The brass plate 51 is stretched on the casing 27 with an insulating sheet 61 interposed between the brass plate 51 and the casing 27 so that it can extend a minimized distance between the winding terminal 56 on the zero potential side of the secondary winding of the transformer 40 and the anode 14 of the magnetron 12. Accordingly, since the casing 27 and the brass plate 51 are insulated from each other, no high frequency electric current flowing between the winding terminal 56 and the anode 14 will flow to the casing 27, thereby eliminating the possibility that the high frequency electric current may form high frequency electromagnetic fields in the casing 27 which would, when radiated outside the casing 27, constitute a cause of noise. It is to be noted that, once such noise has been generated, electric appliances such as a television receiver set will be adversely affected to such an extent that pictures being reproduced on a display may be disturbed or the appliance may operate erroneously.

Figure 22:
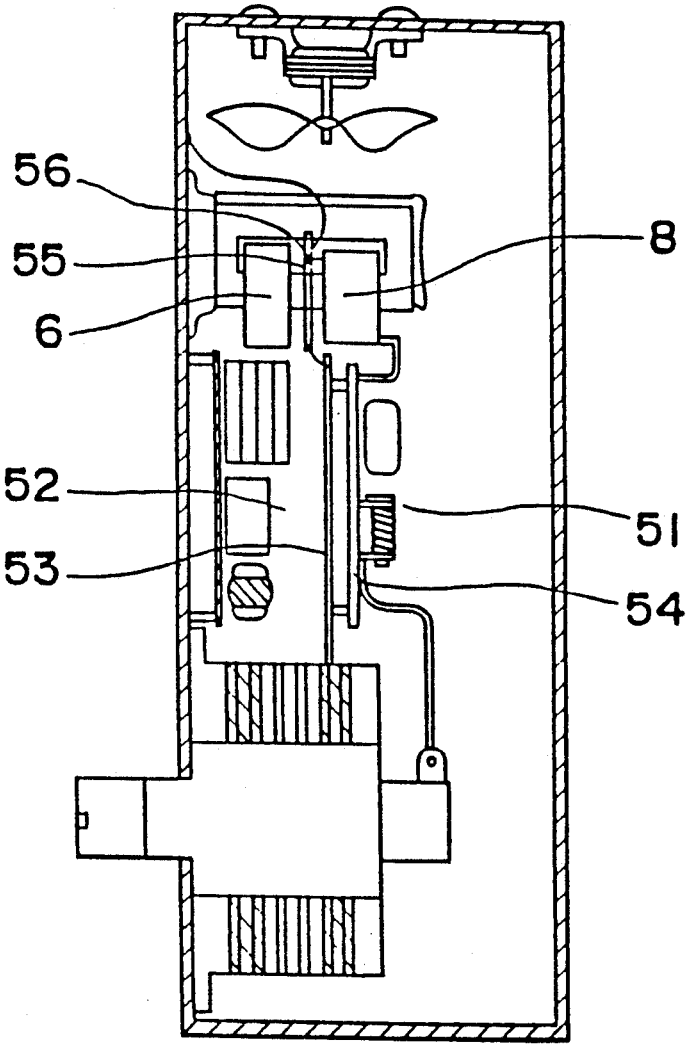
FIG. 22 is a side sectional view of the unitary structure.

FIG. 22 illustrates the unitary structure wherein a high voltage portion 51 and a low voltage portion 52 are separated from each other. Although the high voltage portion 51 and the low voltage portion 52 are separated from each other, a metallic plate 53 utilizing a metallic plate 53 and an insulating plate 54 is electrically connected with a separating plate 55, used to separate the primary and secondary windings 6 and 8 of the transformer 4 from each other, the aluminum cover of the casing 27, and the winding terminal 56 on the zero-potential side of the secondary winding of the transformer 40.

If the high frequency heating apparatus is not electrically connected with the ground, and in the event that component parts such as, for example, a lead line extending from the secondary winding 8 of the transformer 40 and the cathode of the magnetron 12 and/or a capacitor, which applies a high voltage is shortcircuited with the low voltage portion on the side of the primary winding of the transformer 40 by reason of a breakage, the high frequency heating apparatus as a whole may be induced to a high voltage and, if a user of the high frequency heating apparatus touches the high frequency heating apparatus, she or he will be electrocuted.

However, according to the present invention, the high voltage portion 51 and the low voltage portion 52 are separated from each other with the metallic plate 53 and the insulating plate 54 intervening therebetween while the metallic plate 53 is electrically connected with the separating plate 55 separating the primary and secondary windings 6 and 8 of the transformer 40 from each other, the cover of the aluminum casing 27 and the winding terminal 56 on the zero-potential side of the secondary winding of the transformer 40 as hereinbefore described. Therefore, high voltage component parts arranged on the insulating plate 54 will contact the metallic plate 53 the first thing in the event that the insulating plate 54 is damaged. Once this happens, the metallic plate 53 is connected with the winding terminal 56 on the zero-potential side of the secondary winding of the transformer 40 and, therefore, the secondary winding of the transformer 40 will be electrically grounded and an excessive current flow through the primary winding of the transformer 40 so that the semiconductor switching element 7 and/or a fuse will be broken resulting in the inverter power supply 11 brought to a halt. Thus, high voltage applying component parts disposed on lines through which the secondary winding 8 of the transformer 40 is connected with the cathode of the magnetron 12 will not contact the low voltage portion on the primary winding side of the transformer 40 and, therefore, any possible occurrence of electric shocks can advantageously be avoided thereby to secure an improved safety factor.

Although the present invention has been described in connection with the numerous preferred embodiments thereof with reference to the accompanying drawings, it is to be noted that various changes and modifications are apparent to those skilled in the art. Such changes and modifications are, unless they depart from the scope of the present invention as defined by the appended claims, to be understood as being included therein.

What is claimed is:

1. In a high frequency heating apparatus which includes an enclosure having a door, a heating chamber, and a control panel, the improvement comprising:

a unitary structure disposed within the enclosure and outside of the heating chamber comprising: an essentially closed metallic casing, a magnetron disposed within said casing for generating microwaves, an inverter power supply disposed within said casing for supplying a high voltage electric power to said magnetron, and a cooling means disposed within said casing for cooling said magnetron and said inverter power supply; and an abnormality detecting means disposed within said casing and operatively connected to at least one of said inverter power supply, said magnetron, and said cooling means for detecting an occurrence of an abnormal condition in at least one of said inverter power supply, said magnetron and said cooling means, said abnormality detecting means providing information for controlling an operation of said inverter power supply.

2. The heating apparatus as claimed in claim 1, further comprising a switching means for receiving a signal from said abnormality detecting means, said switching means being operable to selectively effect and interrupt a supply of an electric power from an electric power source to said inverter power supply.

3. The heating apparatus as claimed in claim 1, wherein said inverter power supply comprises a semiconductor main switching element and a control circuit for applying a drive signal to said semiconductor main switching element, and further comprises a reference level generating means for generating a reference level and a comparing means for comparing a signal from said abnormality detecting means with said reference level, said control circuit, in response to a signal from said comparing means, applying a signal to said semiconductor main switching element to control an operation of said magnetron.

4. The heating apparatus as claimed in claim 3, further comprising a detecting means for detecting an electric current of at least one of an input and an output of said inverter power supply, wherein said reference level generating means generates said reference level on the basis of said electric current detected by said detecting means.

5. The heating apparatus as claimed in claim 1, wherein said cooling means comprises a fan assembly and a drive motor for driving said fan assembly, and wherein said abnormality detecting means comprises a rotation detecting means for detecting an operation of at least one of said fan assembly and said drive motor.

6. The heating apparatus as claimed in claim 1, wherein said abnormality detecting means comprises a magnetron temperature detecting means for detecting a temperature of said magnetron.

7. The heating apparatus as claimed in claim 1, wherein said abnormality detecting means comprises an element temperature detecting means for detecting a temperature of at least one of a semiconductor main switching element, forming a part of said inverter power supply, and a cooling fin assembly to which said semiconductor switching element is fitted.

* * * * *